US008485095B2

(12) United States Patent
Loddenkoetter

(10) Patent No.: US 8,485,095 B2
(45) Date of Patent: Jul. 16, 2013

(54) DEVICE AND METHOD FOR MEASURING AND SETTING THE WEB TENSION BETWEEN INKING STATIONS OF A MULTICOLOR PRESS

(75) Inventor: Manfred Loddenkoetter, Ibbenbueren (DE)

(73) Assignee: Windmoeller & Hoelscher KG, Lengerich (DE)

( * ) Notice: Subject to any disclaimer, the term of this patent is extended or adjusted under 35 U.S.C. 154(b) by 1201 days.

(21) Appl. No.: 12/223,381

(22) PCT Filed: Jan. 25, 2007

(86) PCT No.: PCT/EP2007/000845

§ 371 (c)(1), (2), (4) Date: Jul. 30, 2008

(87) PCT Pub. No.: WO2007/144031

PCT Pub. Date: Dec. 21, 2007

(65) Prior Publication Data

US 2009/0020641 A1 Jan. 22, 2009

(30) Foreign Application Priority Data

Jan. 31, 2006 (DE) ..... 10 2006 004 307

(51) Int. Cl.

*B41F 33/00* (2006.01)
*B41F 13/02* (2006.01)
*B41F 33/14* (2006.01)

(52) U.S. Cl.

USPC ..... 101/483; 101/181; 101/228; 101/484; 101/485; 101/DIG. 42

(58) Field of Classification Search

USPC ..... 101/483–486, DIG. 42, 228; 242/416
See application file for complete search history.

(56) References Cited

U.S. PATENT DOCUMENTS

| | | | | |
|---|---|---|---|---|
| 3,806,012 | A | 4/1974 | Roch | |
| 4,214,524 | A | 7/1980 | Corse | |
| 4,417,516 | A | 11/1983 | Fischer | |
| 5,269,222 | A | 12/1993 | Johnson et al. | |
| 6,546,871 | B1 | 4/2003 | Glockner | |
| 6,782,818 | B2 * | 8/2004 | Glockner et al. | 101/228 |
| 7,555,985 | B2 * | 7/2009 | Loddenkoetter | 101/486 |
| 7,559,279 | B2 * | 7/2009 | Brandenburg et al. | 101/485 |
| 2002/0108983 | A1 | 8/2002 | Cote | |
| 2006/0150852 | A1 | 7/2006 | Loddenkoetter | |
| 2007/0051264 | A1 * | 3/2007 | Sakamoto | 101/484 |
| 2007/0266879 | A1 * | 11/2007 | Schultze et al. | 101/485 |
| 2008/0148980 | A1 * | 6/2008 | Ollivier et al. | 101/484 |

FOREIGN PATENT DOCUMENTS

| | | | |
|---|---|---|---|
| DE | 102 01 993 | A1 | 8/2002 |
| DE | 101 46 984 | A1 | 4/2003 |
| EP | 0 914 944 | A2 | 5/1999 |
| WO | WO 00/34042 | | 6/2000 |
| WO | WO 2004/048093 | A2 | 6/2004 |

* cited by examiner

*Primary Examiner* — Ren Yan
*Assistant Examiner* — Marissa Ferguson Samreth
(74) *Attorney, Agent, or Firm* — Jacobson Holman PLLC

(57) ABSTRACT

A device for measuring and setting the web tension on a printing press with several inking units ($D_n$) has measuring means ($M_{m,n}$) for measuring the web tension and setting means ($F_n$) for setting the web tension, using which the web tension can be set actively in the case of unsteady web tension conditions.

The measuring means ($M_{m,n}$) and the setting means ($F_n$) are disposed in such a manner that the web tension can be measured and set between the print areas of two inking units. A control device is provided, which controls the setting means based on the measured values of the measuring means ($M_{m,n}$).

17 Claims, 4 Drawing Sheets

RS
α
D1
M1,2
F1
F2
P1
-α
MPg
MPh
H3
s
M
A
S
T1
T2
T3
t

DEVICE AND METHOD FOR MEASURING AND SETTING THE WEB TENSION BETWEEN INKING STATIONS OF A MULTICOLOR PRESS

This is a national stage of PCT/EP07/000845 filed Jan. 25, 2007 and published in German.

The invention relates to a device and a method for measuring and setting the web tension between inking units of a multicolor rotary printing press, as outlined in claims 1 and 2.

Settings of multicolor rotary printing presses are changed frequently. After such changes have been made, the printing press often generates maculature or at least print images of restricted quality.

The object of the present invention is to suggest a device and a method that reduce the printing of maculature or print images of restricted quality.

It has been seen that changes affecting the web tension between inking units of the multicolor printing press exert an especially lasting influence on the print quality.

For purposes of the invention, the term "settings" is therefore meant to connote print parameters that influence the web tension between inking units of the multicolor printing press.

Such settings can be changed during an ongoing print job. These settings effected during the printing process include the positioning of print rollers or a change in printing speed. The term "settings" within the afore-mentioned meaning also includes any predominantly mechanical measures taken when pulling a proof. The positioning of print rollers, the printing start, and pre-registering play an especially important role in this context.

Some of the known devices provided on printing presses and used to measure the web tension include measuring rollers in which the force exerted on the axis of the roller by the web tension can be measured. Other alternatives for measuring the web tension also include measuring the torque of the rollers that transport the web of printable material. It is further known to influence the web tension prevailing in a printing press when pulling a proof by controlling the winder and unwinder or the in-feed unit and drag roller.

The present invention is based on the finding that a special web tension develops between two inking units once the cylinders carrying the print image are positioned against the impression cylinders. The cylinders carrying the print image are those that transfer the print image onto the web of printable material by rolling on the latter. The cylinders carrying the print image are mostly printing plate cylinders, but can also be blanket cylinders in some forms of offset printing.

It has been seen that the special web tension prevailing between the printing units as a result of the setting processes defined above (also due to the positioning of the cylinders carrying the print image) is subjected to an automatically set adaptation. In the wording of this document, there exists an unsteady web-guiding condition between the two related printing units. After a certain period of time, the automatic adaptation process of web tension comes to an end and the web tension changes per unit of time either only within defined tolerance values or it merely fluctuates by an average value. This condition is referred to hereinafter as "steady web-guiding condition".

The afore-mentioned loss in quality as a result of the setting processes mainly comes into existence when unsteady web-guiding conditions are observed. The associated variations in web tension change inter alia the longitudinal register of the printing press, since web tension also results in web elongation and the changing web length causes register errors which then have to be compensated by controlling the register based on the errors occurred. However, the change in web elongation can also result in the print images appearing distorted. It can take a very long time, especially after pulling a proof, until steady web-guiding conditions develop between all the printing units of a multicolor printing press. The present invention addresses this issue by suggesting that:

- at least one measuring means records measured values of the web tension between two inking units,
- and that at least one setting means sets the web tension between the print areas of these two inking units based on the measured values,
- and a control device be used, which controls the at least one setting means based on the measured values of the at least one measuring means.

This makes it possible to shorten the duration of the unsteady conditions of web tension and thus reduce the accumulation of print substrate of low quality.

Web-guiding elements such as guide rollers defining the path of the web of printable material can be used, to advantage, for setting the web tension. When the web-guiding elements change their position relative to the print zones of the (positioned) inking units adjacent thereto, the length of the transport path between the inking units and thus the web tension changes. Another option for influencing the web tension between two inking units is to move those rollers of the adjacent printing units that carry the print images in such a way that their angular position relative to each other changes. It is advantageous, though not necessary, to pre-position these print rollers when they are lifted off from the web of printable material. This is advantageous especially during pre-registration. The previously set longitudinal register can be retained if the amount of this pre-positioning is equal to that of the subsequent setting movement and its algebraic sign is unlike that of the setting movement (other direction of rotation).

The method of the invention can be used to particular advantage during pre-registration. The pre-register method disclosed in the document WO 2004/048093 A2 must be mentioned in this context. In the afore-mentioned document, a method has been introduced that is particularly suitable for pre-registering. In this method, a web of printable material is provided with a marking that is transported on the web through the different inking units of the printing press. Sensors of any kind, which record the passage of the marking, are assigned to the individual inking units. The machine control system can derive information suitable for registration, preferably pre-registration, from the evaluation of the measured values (in particular, the time at which the marking passes the respective inking units). The teaching of the afore-mentioned document with respect to all components of the registering method outlined such as process flow, types of markings, sensors, and measuring methods, etc., are regarded as part of the present application. The applicant of the present invention reserves the right to revert to the disclosure of the afore-mentioned document for supplementing the present invention.

A control device within the meaning of the present document can be any combination of software and/or hardware features and that can generate the mentioned control commands.

Standard values that the web tension is supposed to assume in the steady condition may also be known to the control module. Against the background of these standard values and current measured values recorded in the unsteady condition, the machine control system—that is to say, the control device—can determine by what setting amount it can influence the web tension with the help of the setting means. In doing so, the control device can take the specification of the upcoming print job as the basis. These specifications include the material, its thickness, temperature, and elastic modulus, etc. In the light of this information, the control device can determine the setting amounts with the help of a calculation module, which may likewise be in the form of any software or hardware, taking as a basis the relations between physical properties of materials, for example, such as the Hooke's law. In place of or in addition to the predefined standard values for web tension prevailing in the steady condition, the required information can also be derived empirically on the same printing press and, as far as possible, during the same type of or similar print job. In this context, it is advantageous if the parameters of the print job and the associated web tension values and/or setting amounts for achieving steady web tension are matched to each other and stored. The related data could be in the form of a calibration table and they could also be in a random access memory directly accessible to the control device or at least retrieved there by a machine operator operating the control device.

Another possibility of implementing the method of the invention and thus acquiring empirical values in the first place is if the at least one measuring means informs the control device, before the first control process, about the algebraic sign of the automatically setting variation in web tension. The control device then controls the at least one setting means in such a way that there results another controlled variation in web tension with this algebraic sign and by a predefined amount. This procedure is repeated until the algebraic sign of the automatically setting variation in web tension changes—that is to say, until the value of the web tension prevailing in the steady web tension condition is crossed.

After the value of the web tension prevailing in the steady web tension condition is crossed, either the web tension is no longer regulated in the controlled fashion or the algebraic sign of the controlled variation in web tension is changed. In one form of this "test run" or this "process of actively approximating" the web tension prevailing in the steady web tension condition, it is advantageous if the amount of the controlled variation in web tension is made contingent on the rate of the automatically setting variation in web tension (variation in web tension per unit of time). If the web tension changes rapidly, it may be assumed that the amount of web tension to be changed for achieving the steady web tension (web tension prevailing in the steady condition) is still high. If the web tension changes slowly, this amount is low. Should the amount of the controlled variation in web tension be regulated in this way, this amount may also reduce successively so that the amount by which the steady web tension is crossed (overshoot amount) remains small. Without such a regulation of amount of the intended controlled variation in web tension between measurements, it is also possible to successively reduce the amount of controlled variation in web tension automatically.

It is advantageous to implement the control device with control programs that are suitable to execute the aforementioned advantageous setting methods. Usually, the web tension between two directly adjacent printing units is set. When pulling a proof, in particular, it is advantageous if those areas of the web of printable material that are located between two adjacent printing units and are also referred to as web-guidance sections are successively subjected to the method of the invention. The preferred sequence corresponds to the transport path of the web of printable material.

Additional exemplary embodiments of the invention are explained in the following description and claims.

Figure 1:
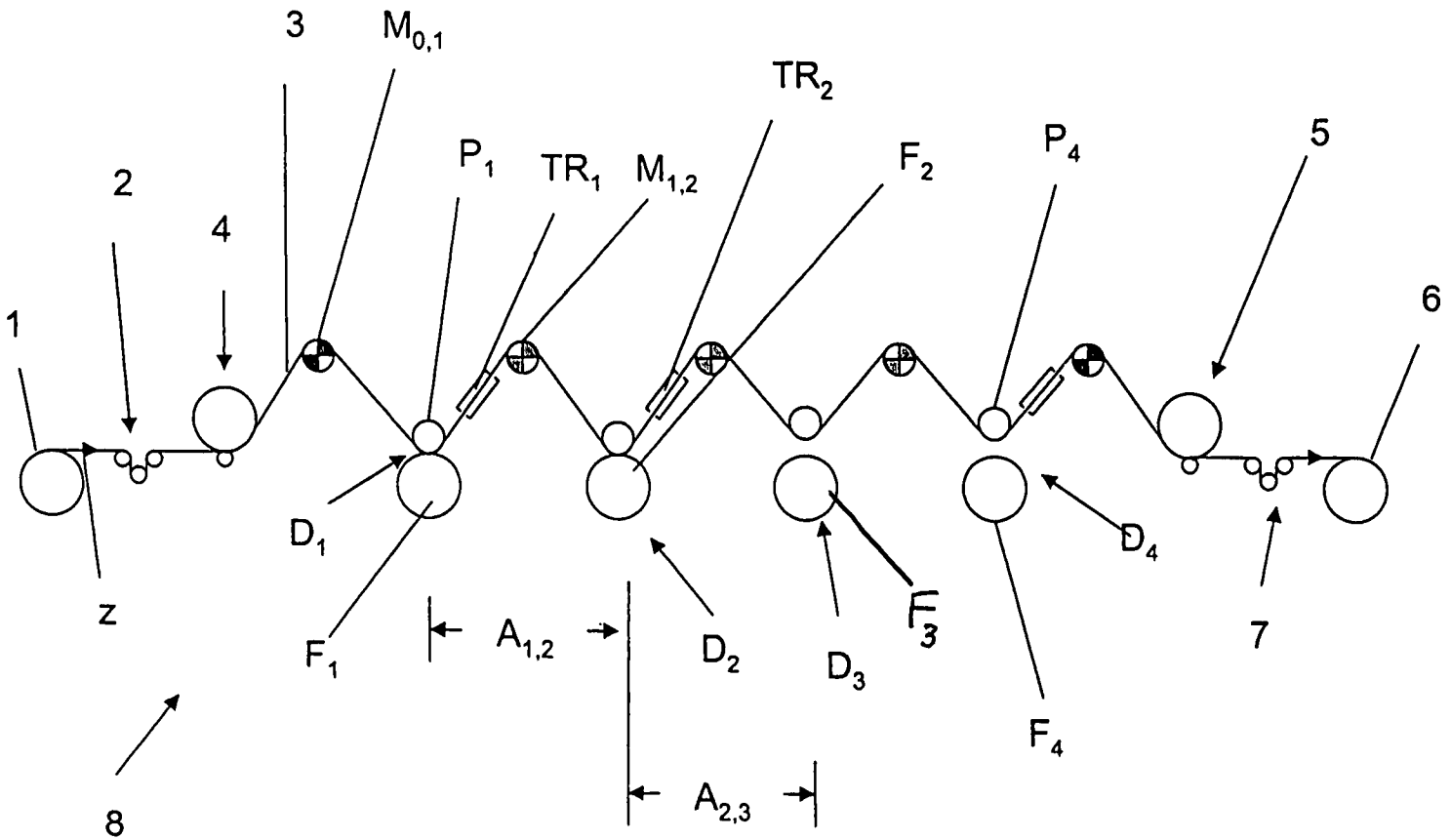
FIG. 1 is a lateral view of a printing press
Figure 2:
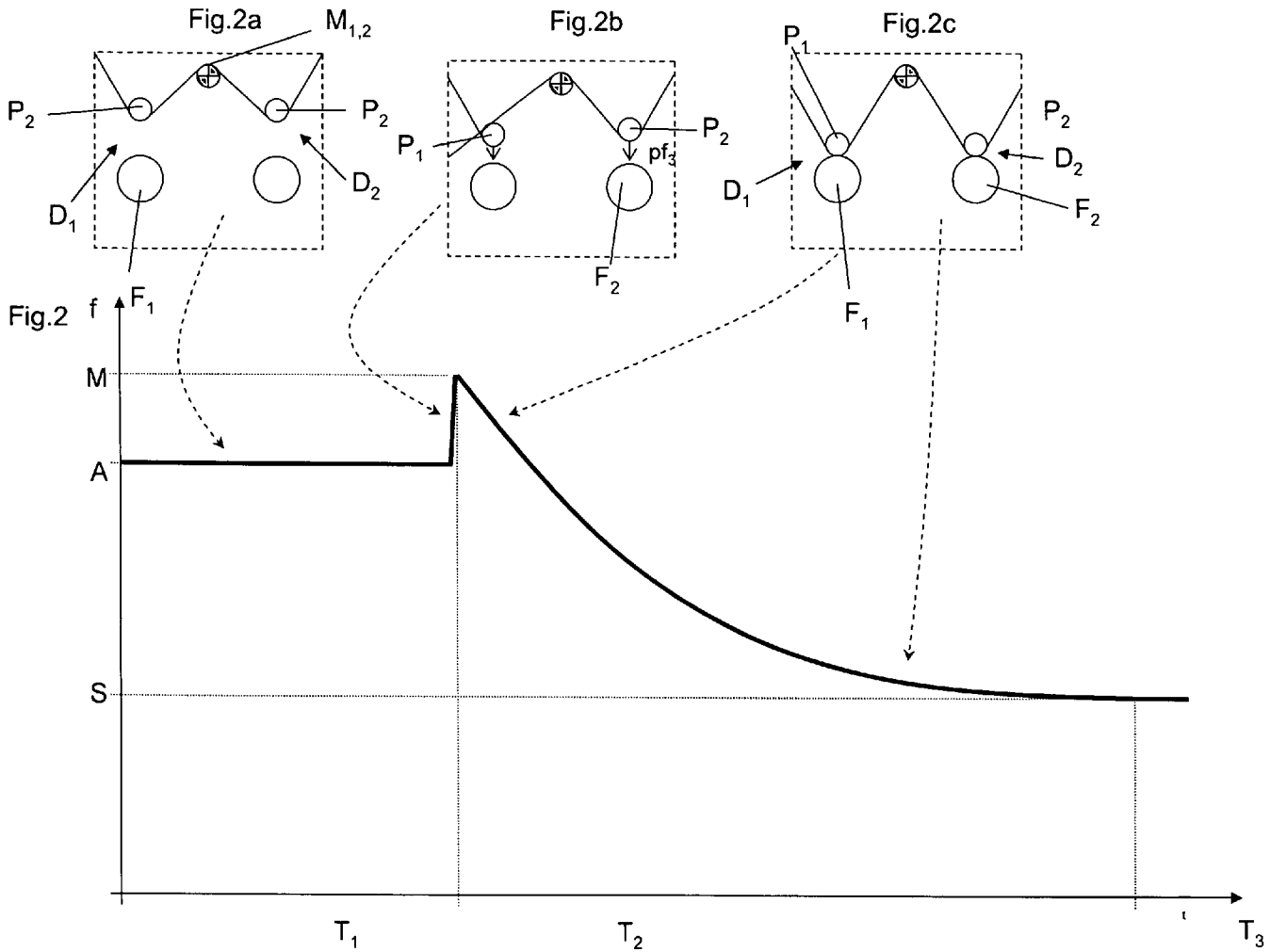
FIG. 2 shows the normal course of web tension as a function of time
Figure 3:
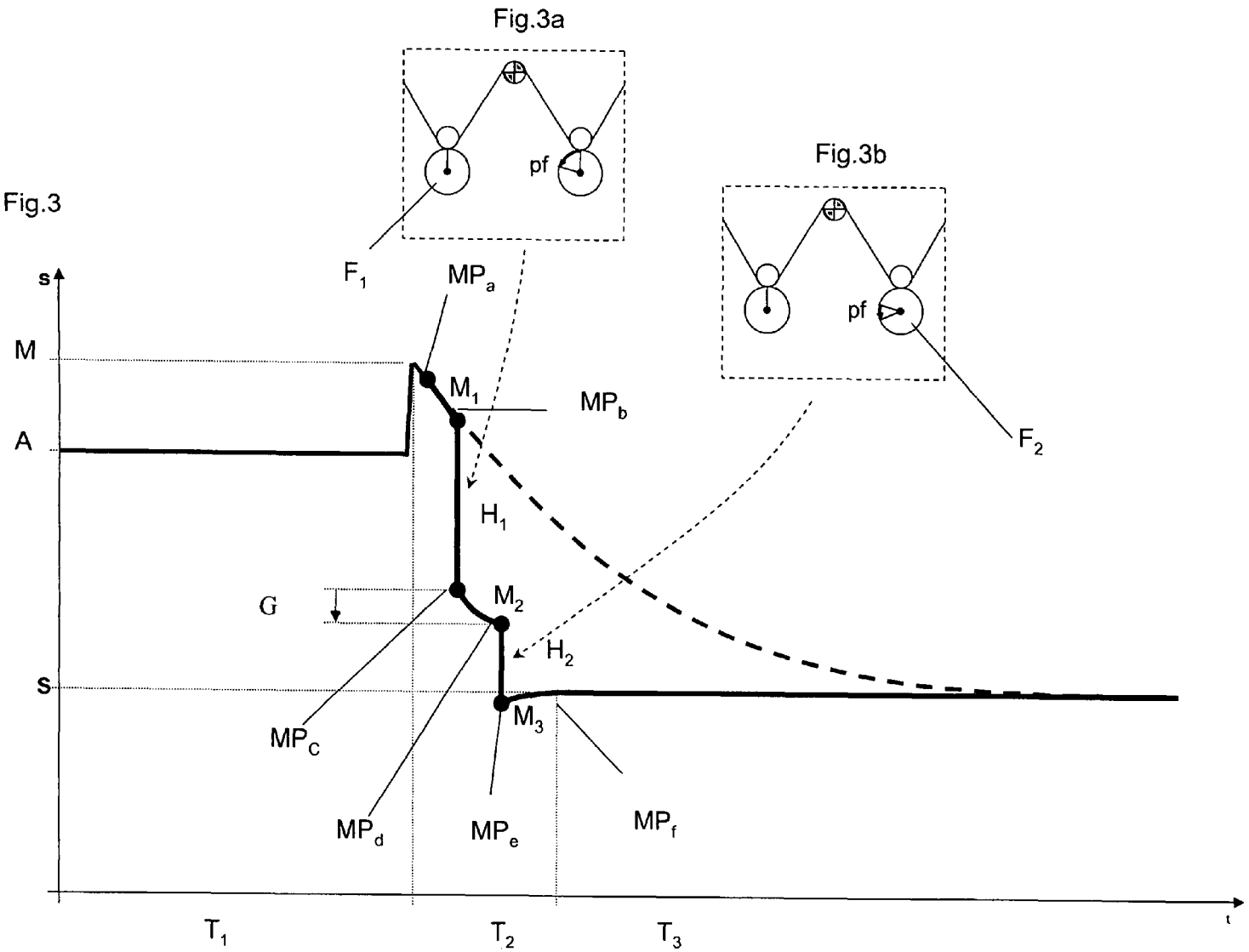
Figures 4, 4A, 4B:
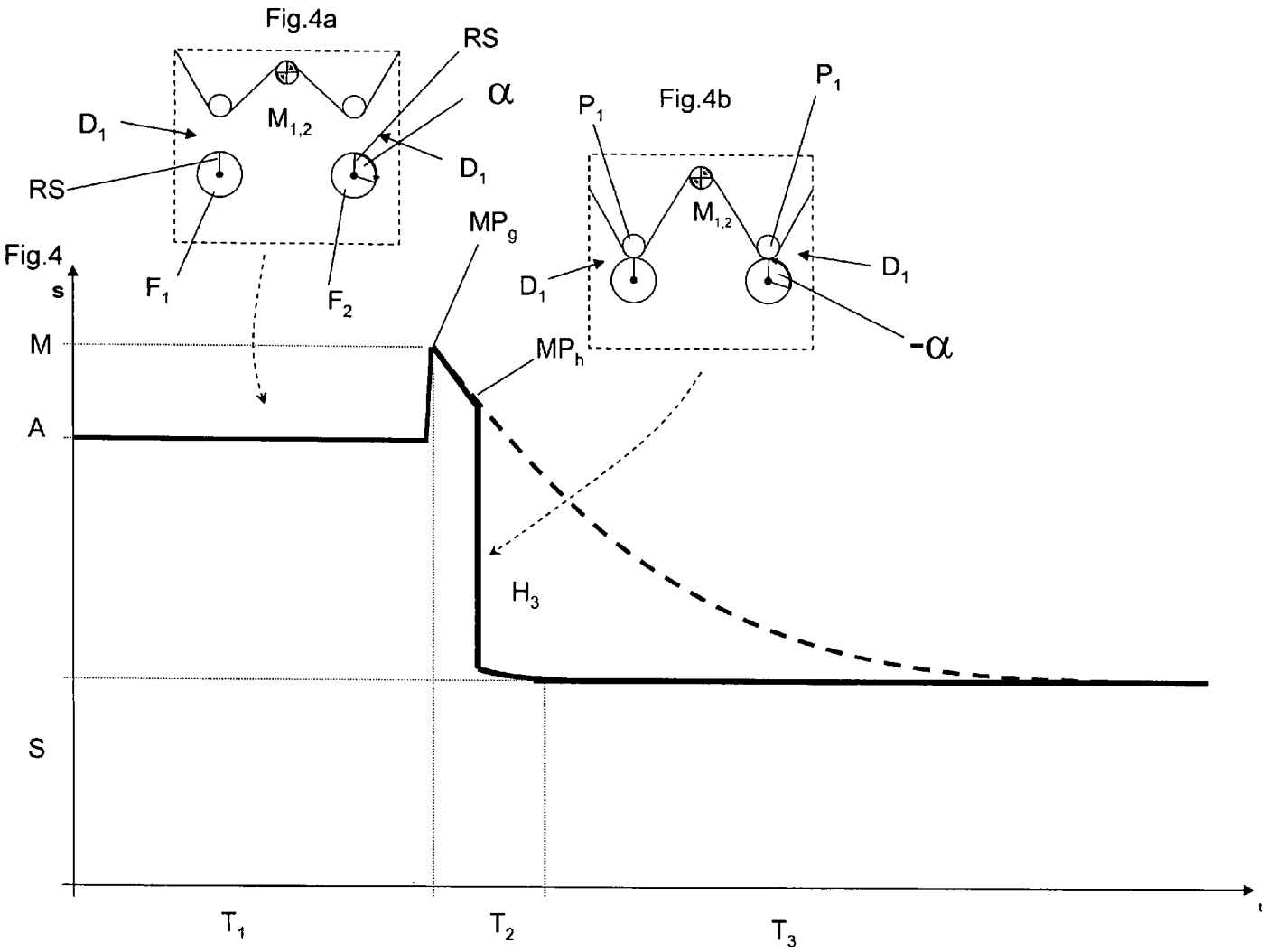

FIG. 2*a* shows the positioning state of two adjacent inking units at a first point in time FIG. 2*b* shows the positioning state of two adjacent inking units at a second point in time FIG. 2*c* shows the positioning state of two adjacent inking units at a third point in time FIG. 3 shows the course of the web tension as a function of time in a test run FIG. 3*a* shows the positioning state of two adjacent inking units at a first point in time FIG. 3*b* shows the positioning state of two adjacent inking units at a second point in time FIG. 4 shows the course of the web tension as a function of time in a rapid setting process FIG. 4*a* shows the positioning state of two adjacent inking units at a first point in time FIG. 4*b* shows the positioning state of two adjacent inking units at a second point in time. FIG. 1 is a lateral view of an in-line gravure printing press. In general, the methods of the invention are especially suitable for use in in-line printing presses, often also referred to as stand machines. The web of printable material 3 is supplied by the unwinder 1 to the printing press in the direction of the arrow z. First, the web of printable material passes through the region of the dancing roller system 2 and then proceeds to the in-feed unit 4. In this connection, it is particularly worth mentioning that the web tension can be set permanently between the in-feed unit 4 and the drag roller 5. However, this setting is not a setting in the sense of the invention, as it is not based on measurements and adjustments between the individual inking units $D_1$ to $D_4$. Only the type of setting suggested by the present invention enables the web tension to be influenced specifically and rapidly in a web tension section $A_{nm}$. After the web of printable material 3 has passed the in-feed unit 4, it proceeds past the first web-tension measuring roller $M_{0,1}$. Next, it arrives in the region of the first printing unit $D_1$, which is equipped with the impression cylinder $P_1$ and the form cylinder $F_1$. After passing through the associated print zone between the two afore-mentioned cylinders, the web 3 passes through a drying unit $TR_1$ indicated in the figures, in order to then be guided again past a web-tension measuring roller $M_{1,2}$. Finally, the web of printable material reaches the second inking unit $D_2$, which comprises a second print zone. The first web-guidance section $A_{1,2}$ is disposed between the roller clearances of the first two printing units $D_1$ and $D_2$. After leaving the second print zone, the web of printable material consequently arrives into the region of the second web-guidance section $A_{2,3}$, which is completed by the third print zone assigned to the third inking unit $D_3$.

Since all inking units are equipped in a similar fashion in the present exemplary embodiment of a gravure printing press, it is not necessary to individually describe the other inking units $D_3$ and $D_4$.

The only point worthy of mention is that the form cylinders $F_3$ and $F_4$ of the inking units $D_3$ and $D_4$ are switched off in the present illustration in FIG. 1. The dancing roller system 2 disposed downstream of the unwinder 1 and the dancing roller system 7 disposed upstream of the winder 6 perform the function of festoons in order to permit the afore-mentioned web-tension regulating processes of the in-feed unit and the drag rollers without exerting tension on the unwinder or the winder. FIG. 2 plots the web-tension course f against time t. The figure shows the web-tension course, as it occurs when a normal proofing is performed at a stand machine and the web tension approaches the steady web tension condition S automatically, that is to say, without any additional control processes. During the period of time $T_1$, no form cylinder is positioned against the associated impression cylinder in the related press. The web tension is therefore determined exclusively by the in-feed unit and the drag roller. This level has the value A. The printing units that are switched off are shown in FIG. 2*a*.

FIG. 2*b* shows the manner of positioning the two form cylinders against the associated impression cylinders $P_1$ and $P_2$. As a result of this measure, a sharp rise in the web tension can be seen in FIG. 2. The web tension rises extremely rapidly from the initial value A to the maximum value M. As a result of the unsteady compensation process during the period of time $T_2$, the web tension drops, similar to a disintegration function, to the value of the steady web tension S. During the period of time $T_2$, the printing press generates maculature since the web tension also affects the web elongation and therefore leads to difficulties especially in maintaining proper print registration between the printing units $D_1$ and $D_2$. FIG. 2*c* shows the two printing units $D_1$ and $D_2$, where both the form cylinders are positioned against their impression cylinders $P_1$ and $P_2$. This condition exists for the entire period of time $T_2$.

FIG. 3 plots the course of the web tension against time. Here, the web tension is adapted to the steady web tension in a controlled manner after having positioned the print rollers. As in the case of FIG. 2, an initial time span $T_1$ with web tension A is observed in FIG. 3. In this time span $T_1$, the web tension is again determined solely by the in-feed unit and drag roller. The positioning of the two form cylinders $F_1$ and $F_2$ against their respective impression rollers $P_1$ and $P_2$ again results in an abrupt rise in web tension. After this rise, the unsteady phase $T_2$ begins, initially with an automatically set compensation process concerning the web tension. This automatically set compensation process causes the web tension to drop by an amount $M_1$, which is recorded by the web-tension measuring roller $M_{1,2}$. The recorded measured values are fed to the control device, which can then determine the algebraic sign of the automatically set change. The control device can also measure the changes in web tension between two measuring points $MP_A$ and $MP_B$ and determine the rate of the variation in web tension by calculating the rate of variation in tension per unit of time. Based on the information of the rate of the variation in web tension between the measuring points $MP_A$ and $MP_B$, the control device determines the stroke or the amount of the controlled variation in web tension $H_1$, the algebraic sign of which it has determined already. After the controlled variation in web tension by the amount $H_1$, the measuring means $M_{1,2}$ repeats the measurement between the measuring points $MP_C$ and $MP_D$ and measures the automatically set variation in web tension $M_2$. The control device can again determine the algebraic sign and the amount of the automatically set variation in web tension $M_2$ from the measuring points $MP_C$ and $MP_D$. Once again, the rate of the variation in web tension between the two afore-mentioned measuring points can be determined from these data. The control device again changes the web tension in a controlled fashion by the amount $H_2$ by controlling the setting means, and determines the algebraic sign and amount of the variation in web tension based on the measured values. The control device again measures the variation in web tension between the measuring points $MP_E$ and $MP_F$ with the help of the measuring means $M_{1,2}$ and establishes that the algebraic sign of the automatically set variation in web tension $M_3$ has changed and that the rate of the variation in web tension is very low. The web tension thus need not be changed in a controlled fashion any further. The amount by which the web tension at the measuring point $MP_E$ falls below the steady web tension S is referred to hereinafter as overshoot. In comparison to the situation shown in FIG. 2, note should be taken of the fact that the time span $T_2$, in which the compensation process of the web tension is performed up to the steady web tension prevailing in the time span $T_3$ is very much shorter than the one in FIG. 2 in which this steady web tension is exclusively set automatically. Naturally, the printing press generates much less maculature in a situation shown in FIG. 3 during the time span $T_2$ than in the situation shown in FIG. 2.

FIGS. 3*a* and 3*b* again show the positioning and compensation behavior of the printing units during the setting processes. In the case described, the setting processes are executed with the help of movements of the form cylinder—that is to say, in this case $F_2$. These setting processes are symbolized by the arrows pf. They result in a change in the relative angular position of the two form cylinders $F_1$ and $F_2$.

FIG. 4 again shows another controlled compensation process, which is executed with the stroke $H_3$. The speed of the unsteady compensation process is again higher as compared to FIG. 3. The stroke $H_3$ compensates almost the entire difference in web tension between the measuring point MPH and the steady web tension S. Such compensation processes can come into existence, in particular, if the steady web tension S is known to the control device from the outset. This may be the case if the control device operates auto-adaptively. That is to say, that the steady web tension prevailing on a printing unit during a print job is known to the control device in the form of a calibration table since such a web tension has already been set once when processing an earlier print job.

A particularly advantageous embodiment of the invention will become obvious from a review of FIGS. 4, 4*a*, and 4*b*:

During the phase $T_1$, the form cylinders $F_1$ and $F_2$ are lifted off from the impression cylinders and the web 3. It is possible to determine a register target position either by means of a special pre-registration process (e.g. a web-cylinder process) during this phase or by way of a pre-registration before this phase $T_1$. Normally, it would then be most advantageous to mutually coordinate the angular position of the two form cylinders $F_1$ and $F_2$ based on this register target position, and this coordination is usually performed by means of a corresponding movement of the rear cylinder, which is $F_2$ in this case. This movement can also be implemented in connection with the method suggested by the present invention. However, it is more advantageous to preset an angular position deviating from the target position RS by an angle $\alpha$instead of the exact register target position RS of the two cylinders in relation to each other. A rotation around the angle $\alpha$ is suitable in the printing position (FIG. 4*b*) in order to adjust the stroke $H_3$ in the course of the web tension, as shown in FIG. 4. The active compensation process represented by the stroke $H_3$, as shown in FIG. 4*b*, is compensated by an angular rotation around $\alpha$, that is to say, a rotation around the angle $\alpha$ in the reverse direction. The required steady web tension S is usually known to the control device of the printing press. It is extremely easy to determine the required web tension stroke $H_3$ by measuring a web tension prevailing during the period of time $T_2$.

Even before this measurement is performed, such a web tension stroke or the automatically setting web tension can be known to the control device by way of an estimation or by means of empirical values (measured values in earlier or optionally similar print jobs. The web tension can be similar after the positioning of the rollers). In this case, the method of the invention also includes measurement operations even if these have been performed in printing processes that have already been completed. A printing press suited to implement this method therefore also includes such measuring devices. However, it also appears possible to implement such a method on at least one or more web-guidance sections, if not in the entire printing press, without performing measurements there or without subjecting the related web-guidance sections $A_{n,m}$ to corresponding web-tension measuring devices. In this case, calculated and/or empirical values (e.g. of other printing presses) would have to form the background of the setting process.

The angle $\alpha$ corresponding to the stroke $H_3$ is likewise either known to the printing press or is determined by means of known relations between physical properties of materials, such as the Hooke's law. In this connection, it is advantageous to have the most precise possible knowledge of material parameters (such as the elastic modulus) of the web of printable material 3.

The course of the method shown in FIGS. 4, 4*a*, and 4*b* can be outlined as follows:

- the web tension is set after implementing a pre-registering method, in which a register target position RS is determined, but not necessarily set,
- the cylinders ($F_n$) carrying the print image are pre-positioned (around the angle $\alpha$ in relation to the register target position) before the setting process, and this pre-positioning is effected while the related cylinder carrying the print image is lifted off from the web (3),
- the cylinders ($F_n$), which carry the print image and are pre-positioned before the setting process by the amount (angle $\alpha$) required for the settings, are set (in particular, for the purpose of regulating the web tension to the specified value of steady web tension S by rotation about $-\alpha$), the pre-positioning and the setting having unlike algebraic signs,
- so that the previously determined register target position RS for longitudinal registration is set.

The term "setting" or "setting process" above is primarily used for the setting of the web tension.

The printing plate cylinder/s can be rotated into the register target position before their pre-positioning. However, it seems advantageous to directly bring about that angular position of the adjacent, consecutive printing plate cylinders that results when the pre-setting (around the angle $\alpha$) occurs additionally (pre-positioning around the angle $\alpha$ in relation to the target position RS at the register target position RS.

This method considerably accelerates the (normally passively occurring) "active" setting of the steady web tension. The isolated application of each of the afore-mentioned process steps therefore appears to be advantageous in itself. When applying the entire method, it even appears possible, in this way, to bring about this setting while a single web section of the length of the web path between the unwinder and the winder passes through the printing press. This would also significantly reduce the amount of maculature generated.

The afore-mentioned process steps can be implemented by a control device. Here, the term "control device" must be understood as a functional expression. A control device in the form of an industrial computer is usually present as a central unit that combines a large part of the intelligence required for operating the printing press. However, this term also encompasses all possible, decentralized forms of control units.

A control unit can be supplied with control means for automatically executing defined processes. Such control means could be function commands—thus mainly software. But such control means can also include hardware components such as electronic components like AND or NAND components.

| List of reference numerals | |
|---|---|
| 1 | Unwinder |
| 2 | Dancing roller system |
| 3 | Web of printable material |
| 4 | In-feed unit |
| 5 | Drag roller |
| 6 | Winder |
| 7 | Dancing roller system |
| 8 | Printing press |
| $A_{nm}$ | Web tension section |
| $A_{1,2}$, $A_{2,3}$ | Web-guidance section |
| $D_{1,2,3}/D_n$ | Printing unit 1, 2, 3 |
| $F_{1,2,3,4}/F_n$ | Form cylinder 1, 2, 3, 4 |
| $H_3/A_z$ | Stroke (here, active variation in web tension) |
| $M_{m,n}$ | Web-tension measuring roller 0, 1 |
| $MP_{A\text{-}PH}$ | Measuring point |
| $P_{1,2,3,4}/P_n$ | Impression cylinder 1, 2, 3, 4 |
| $T_{1,2,3}/T_n$ | Periods of time |
| pf | Arrow in the direction of the setting movement of the form cylinder |
| $TR_{1,2,3}$ | Drying unit 1, 2, 3 |
| f | Web tension course, web tension control variable |
| S | Steady web tension |
| $\alpha$ | Angle (amount) of the pre-setting movement of the form cylinder |
| $-\alpha$ | Angle (amount) of the setting movement of the form cylinder |

The invention claimed is:

1. A device for measuring and setting a web tension on a printing press having a plurality of inking units ($D_n$), comprising:

- a measuring element ($M_{m,n}$) for measuring the web tension and a setting element ($F_n$) for setting the web tension, using which the web tension can be set actively in a case of unsteady web tension conditions,
- the measuring element ($M_{m,n}$) and the setting element ($F_n$) being disposed in such a manner that the web tension can be measured and set between print areas of two of the inking units; and
- a control device, which controls the setting element based on the measured values of the measuring element ($M_{m,n}$),
- with cylinders carrying a print image being pre-positioned before the web tension setting, the pre-positioning being effected while a related cylinder carrying the print image is lifted off from the web, and
- with the cylinders carrying the print image being pre-positioned before the web tension setting based on an angular amount required for setting the web tension, a pre-positioning angle ($\alpha$) and a setting angle ($-\alpha$) having unlike algebraic signs and equal values,
- the control device having at least one of hardware and software components that include
- a first control element for setting the web tension in a pre-registering method for determining a register target position,
- a second control element for the pre-positioning of the cylinders carrying the print image, the second control element pre-positioning at least one of the cylinders before the setting process based on the pre-positioning angle ($\alpha$) in relation to the register target position, the pre-positioning being effected while the related cylinder carrying the print image is lifted off from the web, and a third control element, which adjusts at least one cylinder carrying a print image around the setting angle ($-\alpha$), so that the previously determined register target position for longitudinal registration is set.

2. The device according to claim 1 wherein the cylinders carrying the print image are used as the setting element ($F_n$).

3. The device according to claim 1 wherein the web tension is adjusted to accelerate the setting processes when pulling a proof.

4. The device according to claim 1 wherein standard values for the web tension prevailing between the two inking units ($D_n$) are known to the control system device and the web tension is set based at least on the measured values and the standard values.

5. The device according to claim 1 wherein the control device has a calculation module, which calculates an amount and the algebraic sign of the controlled web tension setting from measured values of the web tension prevailing in a steady condition, in which an automatically set variation in web tension per unit of time is below both defined target values, and the current measured values of the web tension.

6. The device according to claim 5 wherein the calculation module takes into account specific data of a print job including a type and thickness of printed materials when calculating the amount and algebraic sign of the web tension setting.

7. The device according to claim 6 wherein, in the calculation module, the amount and the algebraic sign of completed or calculated web tension setting are assigned to specific data of the print job including a type and thickness of the printed materials during which the related settings were made.

8. The device according to claim 1 wherein the measurements and settings are performed in regions located between two directly adjacent inking units ($D_n$).

9. The device according to claim 8 wherein the measurements and settings are performed in at least two regions in an order in which the web of a printable material passes through the printing press.

10. A method of measuring and setting a web tension on a printing press having a plurality of inking units ($D_n$), said method comprising the steps of:

using a measuring element ($M_{m,n}$) for measuring the web tension and a setting element ($F_n$) for setting the web tension, the measuring element ($M_{m,n}$) recording measured values of the web tension between two of the inking units ($D_n$) and the setting element adjusting the web tension between print areas of the two inking units ($D_n$) based on the measured values; and using a control device to control the setting element based on the measured values of the measuring element ($M_{m,n}$), with cylinders carrying a print image being pre-positioned before the web tension setting, the pre-positioning being effected while a related cylinder carrying the print image is lifted off from the web, and with the cylinders carrying the print image being pre-positioned before the web tension setting based on an angular amount required for setting the web tension, a pre-positioning angle ($\alpha$) and a setting angle ($-\alpha$) having unlike algebraic signs and equal values, the step of controlling the setting element including using the control device having at least one of hardware and software components that include a first control element for setting the web tension in a pre-registering method for determining a register target position, a second control element for the pre-positioning of the cylinders carrying the print image, the second control element pre-positioning at least one of the cylinders before the setting process based on the pre-positioning angle ($\alpha$) in relation to the register target position, the pre-positioning being effected while the related cylinder carrying the print image is lifted off from the web, and a third control element, which adjusts at least one cylinder carrying a print image around the setting angle ($-\alpha$), so that the previously determined register target position for longitudinal registration is set.

11. The method according to claim 10 wherein web-guiding elements determining a course of the web of printable material are used as the setting element ($F_n$).

12. The method according to claim 10 wherein the web tension is set after a pre-registering method has been implemented, in which a register target position is determined.

13. The method according to claim 12 wherein, in the pre-registering method, a web of printable material provided with a web marking is guided through at least two printing units, and a time at which the marking passes through print zones of the two inking units ($D_n$) is recorded and the recorded time is taken by the control device as a basis for pre-registration.

14. The method according to claim 10 wherein the measuring element ($M_{m,n}$) measures an algebraic sign of an automatically set variation in the web tension for unsteady web tension conditions, and/or the control device determines the algebraic sign of the variation in the web tension based on the unsteady web tension conditions, the control device thereupon controls the setting element in such a way that a controlled variation in the web tension is effected by a predetermined amount with the algebraic sign of the automatic variation in the web tension.

15. The method according to claim 14 wherein a first controlled variation in the web tension by a predetermined amount is followed by at least another controlled variation in the web tension.

16. The method according to claim 14 wherein after the controlled variation in web tension, the measuring element ($M_{m,n}$) records the automatically set variation in the web tension with no other controlled changes in web tension having the original algebraic sign being effected, if the algebraic sign of the automatically set variation in the web tension changes or if the automatically set variation in the web tension is no longer measurable.

17. The method according to claim 16 wherein the control device records, in a storage unit, the amount and the algebraic sign of the web tension setting, which are performed until the algebraic sign of the automatically set variation in the web tension changes or until the automatically set variation in the web tension is no longer measurable, and the control device adjusts the amount and/or algebraic sign during a subsequent occurrence of an unsteady web tension condition.

* * * * *